United States Patent [19]

Carr et al.

[11] 4,356,960

[45] Nov. 2, 1982

[54] ANTI-DRAG CAP FOR BASKET CENTRIFUGE

[75] Inventors: Robert B. Carr, Brookline, Mass.; Richard A. Erikson, Poughkeepsie, N.Y.

[73] Assignee: Alfa-Laval, Inc., Poughkeepsie, N.Y.

[21] Appl. No.: 153,002

[22] Filed: May 27, 1980 (Under 37 CFR 1.47)

[51] Int. Cl.[3] ..... B04B 11/00

[52] U.S. Cl. ..... 233/46

[58] Field of Search ..... 233/46, 47 R, 38, 39, 233/27, 28, 11, 3

[56] References Cited

U.S. PATENT DOCUMENTS

| | | | |
|---|---|---|---|
| 3,080,108 | 3/1963 | Jacobson | 233/28 X |
| 3,201,036 | 8/1965 | Halbach | 233/46 X |
| 3,204,868 | 9/1965 | Honeychurch | 233/46 X |
| 3,937,397 | 2/1976 | Zitke | 233/21 |

*Primary Examiner*—Edward J. McCarthy

*Attorney, Agent, or Firm*—Amster, Rothstein & Engelberg

[57] ABSTRACT

From the centrifugal basket chamber to which the liquid-solids mixture is fed, the separated liquid discharges through an overflow outlet at the radially inner edge of an annular horizontal wall forming the upper end of said chamber, the discharging liquid then flowing upwardly along the inner surface of an annular vertical wall protruding upwardly from said horizontal wall and then flowing radially outward along the upper surface of a lip which overlies only the radially inner part of said horizontal wall in spaced relation thereto. The discharging liquid is thus prevented from contacting the upper surface of said horizontal wall and thereby imposing a drag on the rotating basket.

3 Claims, 4 Drawing Figures

ANTI-DRAG CAP FOR BASKET CENTRIFUGE

This invention relates to basket centrifuges of the type in which the rotary basket has a bottom outlet for discharging separated solids and an overflow outlet at the upper end of the basket for discharging separated liquid. More particularly, the invention rotates to an improved centrifugal basket which substantially reduces the power consumption of the centrifuge.

In conventional centrifuges of the above-noted type, the basket is rotated on a vertical axis while receiving in its annular chamber a feed mixture of liquid and solids. The solids, being of higher specific gravity than the liquid, accumulate in the outer peripheral part of the basket chamber, from where they are discharged intermittently through the basket's bottom outlet. The separated liquid, on the other hand, is displaced radially inward to and through its overflow outlet formed by the radially inner edge of a generally horizontal annular wall constituting the top of the basket chamber, this top wall being commonly referred to as the basket cap.

The separated liquid discharging from the overflow outlet, after being immediately flung radially outward by centrifugal force, enters a stationary collecting chamber surrounding the basket and from which the liquid is eventually discharged. However, in conventional centrifuges of the above-noted type, the liquid flung radially outward from the overflow outlet first contacts a substantial area of the upper surface of the basket cap before entering the stationary collecting chamber.

We have found that such contact between the discharging liquid and the upper surface of the basket cap imposes enough drag on the basket to require a significant extra power consumption to overcome the drag while driving the basket, this extra power consumption being greater with more viscous liquids. More particularly, because of the friction between the upper surface of the rotating cap and the liquid, the latter is accelerated as it flows along the cap to its outer edge, and it is this acceleration which consumes substantial power.

The principal object of the present invention is to provide a basket centrifuge of the above-noted type which can be operated with substantially less power consumption than previously required.

In a basket centrifuge made according to the invention, the basket cap has a generally horizontal annular wall forming the top of the basket chamber, and a generally vertial annular wall protrudes upwardly from the radially inner portion of the horizontal wall. Thus, the inner surface of the vertical annular wall defines the overflow outlet through which an annular stream of the separated liquid discharges upwardly. In this way, the discharging liquid is not flung radially outward until it emerges from the upper end of the vertical annular wall. However, even though this upper end is located well above the upper surface of the horizontal annular wall, we have found that the outwardly moving liquid will nevertheless contact a substantial area of said upper surface, at least at its radially outer portion, unless a further measure is taken to prevent such contact.

According to the present invention, this further measure comprises the provision of an annular lip extending radially outward from the upper end of the vertical annular wall and overlying only the radially inner part of the horizontal annular wall in spaced relation thereto. Preferably, the lip has an annular lower surface slanting downward and radially inward from the outer edge of the lip.

For a better understanding of the invention, reference may be had to the following description in conjunction with the accompanying drawings, in which FIG. 1 is a vertical sectional view of a conventional basket centrifuge of the type described above;

Figure 1:
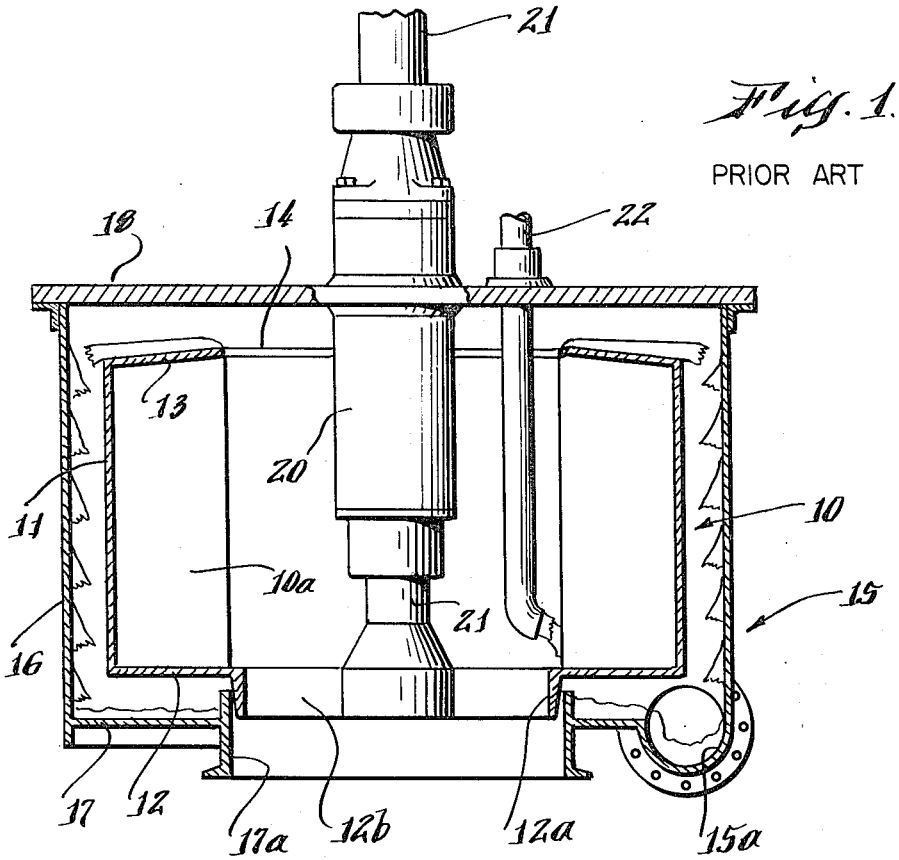
Fig. 1. PRIOR ART

Referring to FIG. 1, the conventional basket centrifuge there shown comprises a cylindrical basket 10 open at both ends to form an annular separating chamber 10*a*. The basket comprises an imperforate peripheral wall 11, a bottom 12 forming an outlet 12*a* for separated solids, and a generally horizontal annular wall 13 which constitutes a cap defining the upper end of basket chamber 10*a*. The inner edge of cap 13 forms an overflow outlet 4 for separated liquid.

Basket 10 is mounted for rotation about a vertical axis within a stationary housing 15. The latter comprises a cylinrical vertical wall 16 surrounding the basket, a bottom 17 forming a central outlet 17*a* surrounding the basket's bottom outlet 12*a*, and a removable cover 18. A bearing housing 20 extends centrally through cover 18 and is secured thereto, this housing containing suitable bearings (not shown) for supporting a vertical drive shaft 21 on which basket 10 is suspended. More particularly, the lower end of shaft 21 is secured to radial spokes 12*b* located in the basket outlet 12*a* and forming part of the basket bottom 12. This manner of supporting the basket is disclosed in further detail in U.S. Pat. No. 3,937,397 granted Feb. 10, 1976. It will be understood that shaft 21 is driven by any suitable means (not shown).

In the operation of the centrifuge shown in FIG. 1, the liquid-solids mixture to be separated is fed through a stationary feed pipe 22 into chamber 10*a* of the rotating basket, so that the mixture is brought into rotation. Under the action of centrifugal force, the solids collect in the outer part of the basket while separated liquid discharges continuously through overflow outlet 14. The accumulated solids are discharged intermittently through bottom outlet 12*a* in any suitable manner. For example, cover 18 may support a shoe (not shown) which is movable radially from a retracted position into a position for plowing the solids from the basket while it continues to rotate, as disclosed in said U.S. Pat. No. 3,937,397. Alternatively, rotation of the basket may be arrested while discontinuing the feed through pipe 22, so that the solids automatically fall through bottom outlet 12*a*.

The liquid discharging from overflow outlet 14 is flung outward by centrifugal force and contacts the upper surface of cap 13 while flowing to its outer edge, from which the liquid is flung against the surrounding housing wall 16. The liquid collected at the bottom of housing 15 is discharged through a separate outlet 15*a*.

As previously mentioned, a substantial amount of power s consumed in accelerating the discharging liquid as it contacts the upper surface of cap 13 while flowing from the small radius at overflow outlet 14 to the greater radius at the outer edge of the cap. This contact is at least largely avoided by the present invention, an example of which is shown in FIG. 2.

Figure 2:
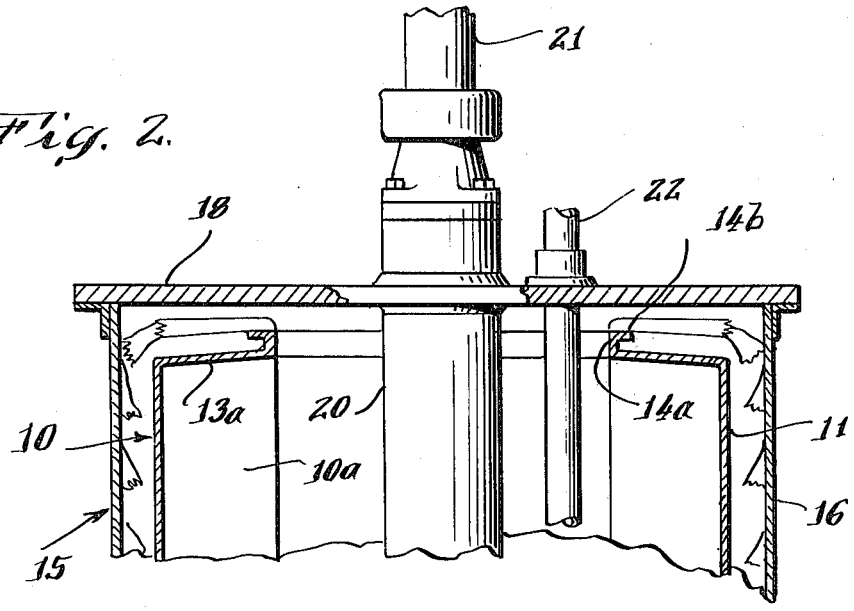
FIG. 2 is a view similar to FIG. 1 but showing only the upper portion of the centrifuge with a basket cap made according to the invention.

The centrifuge in FIG. 2 is identical to that shown in FIG. 1, except that the basket cap 13 in FIG. 1 is replaced by cap 13*a* in FIG. 2. The cap 13*a* includes the usual generally horizontal annular wall forming the upper end of the basket chamber. However, extending upwardly from the inner edge of this horizontal wall is a vertical annular wall 14*a*, the upper end of which is located a substantial distance above the horizontal wall. Cap 13*a* also comprises a horizontal lip 14*b* extending radially outward from and surrounding the upper end of annular wall 14*a*. The radial extent of lip 14*b* is only a small fraction of the radial extent of cap 13*a*, so that the lip overlies and is spaced from only the radially innermost part of the cap's horizontal wall.

Figure 3:
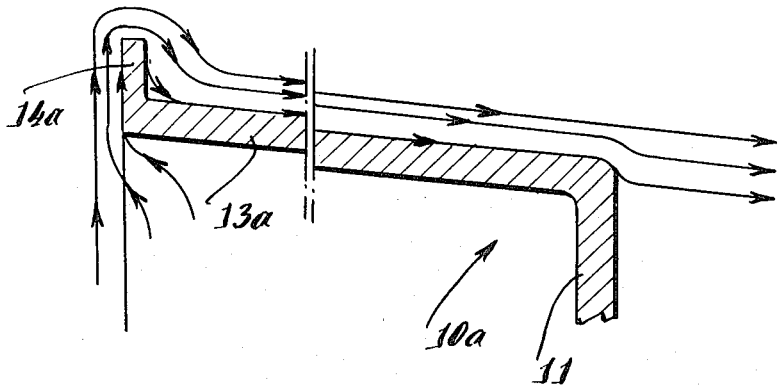
FIG. 3 is a detailed vertical sectional view of part of a basket cap showing the effect of the vertical annular wall without the aforementioned radial lip.
Figure 4:
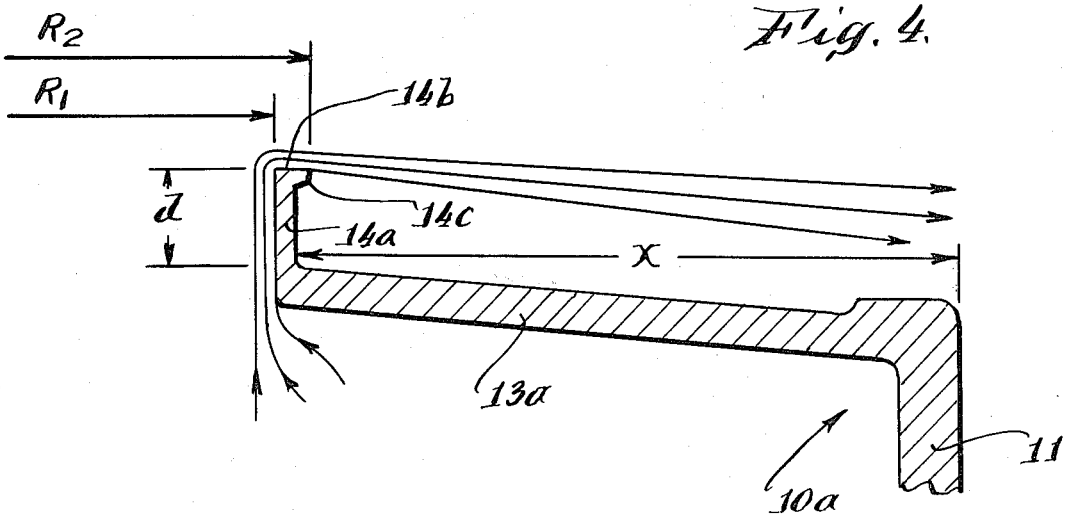
FIG. 4 is a view similar to FIG. 3 but showing the effect of the radial lip.

The effect of the lip 14*b* can be easily understood by comparing FIGS. 3 and 4. As shown by the arrows in FIG. 3, where the lip is omitted, the liquid discharging from basket chamber 10*a* flows upwardly along the inner surface of annular wall 14*a* and then radially outward along the top edge of this wall. The liquid then tracks downward along the outer surface of annular wall 14*a* until it is pulled free of this outer surface by centrifugal force; but by this time the liquid has acquired sufficient downward momentum to carry it into contact with the cap's upper surface at a substantial distance inward from the cap's outer edge. Thus, the liquid will contact a considerable area of the cap while flowing to its outer edge.

In FIG. 3, the arrows indicate the flow of a moderately viscous liquid (e.g., with a viscosity greater than 100 cp). If the liquid is less viscous, or if the centrifugal force is increased by increasing the rotational speed of the basket, the liquid flow will be similar to that in FIG. 3 except that the liquid will track a shorter distance down the outer surface of annular wall 14*a* before being pulled free of this surace. Consequently, the liquid will first contact the cap's upper surface at a greater radius than in FIG. 3. Although this reduces the total contact area and thus the amount of acceleration of the discharging liquid, thereby reducing the drag and the power consumption, the effect of the drag is only partially relieved.

As shown by the arrows in FIG. 4, the lip 14*b* prevents the aforementioned downward tracking to occur, it would be necessary for the liquid to track backwards (radially inward) directly against the centrifugal force, which would be impossible even with the most viscous liquid. Consequently, the discharging liquid leaves the lip 14*b* at such an elevated level that it cannot contact the upper surface of cap 13*a* but is flung directly against the stationary wall 16 of the housing (FIG. 2).

Preferably, the lip has a lower surface 14*c* which slants downwardly and radially inward from the lip's outer edge. The latter is thus quite sharp and therefore more effective in preventing any downward tracking of the discharging liquid.

Of course, even with the elevated lip 14*b*, the stream of liquid leaving this lip will be pulled downward somewhat by gravity as it approaches the stationary wall 16 of the housing, as shown by the arrows in FIG. 4. For a given elevation of the lip, the extent to which the liquid stream clears the outer edge of cap 13*a* will depend mainly upon two factors, namely, the velocity at which it exits from the lip 14*b* and the radial (horiontal) distance X from vertical wall 14*a* to the outer edge of cap 13*a*, as shown in FIG. 4. Accordingly, those two factors must be taken into account in determining the minimum height of annular wall 14*a* for avoiding contact between the outwardly discharging liquid and the upper surface of cap 13*a* in a particular centrifuge, this minumum height being indicated at d in FIG. 4. In practice, the minimum height d can be determined from the equation $$d = \tfrac{1}{2}a\left[\frac{X}{VT}\right]^2,$$

where a is the gravitational constant and VT is the velocity at which the liquid stream exits from lip 14*b*. The latter velocity is determined from the equation $VT=(Vt^2+Vr^2)^{\frac{1}{2}}$, where Vt is the tangential velocity and Vr is the radial velocity of the exiting stream. The latter two velocities can be determined from the following equations:

$$Vt=rw$$

$$Vr=w(R2^2-R1^2)^{\frac{1}{2}}$$

where r is the radius of the basket cap, w is the rotational speed of the basket, and R2 and R1 are the outer radius and the inner radius, respectively, of the lip 14*b*.

Calculations and testing show that the present invention can effect a saving of at least 19 H.P. in a clarifier centrifuge having a hydraulic drive of 60 H.P. Use of the invention on clarifier centrifuges will practically eliminate the adverse effects of the discharging liquid having a high viscosity and will allow the centrifuge to be applied to processes where it was unsatisfactory heretofore because the effects of high viscosity caused undue "speed droop" (speed reduction) and substantially reduced product clarification. Moreover, even with low viscosity liquids such as water slurries, speed droop occurs to some extent upon decantation. Thus, considering the low cost of incorporating the present invention in a basket centrifuge, it would be desirable to make it a standard feature on all clarifier baskets.

We claim:

1. In a basket-type centrifuge, a centrifugal basket mounted for rotation about a generally vertical axis and forming an annular chamber surrounding said axis for receiving a mixture of liquid and solids to be separated, the basket having a bottom outlet for discharging separated solids from said chamber and also having a cap forming an overflow outlet for discharging separated liquid from said chamber, said cap including a generally horizontal annular wall overlying said chamber and a generally vertical annular wall protruding upwardly from the radially inner portion of said horizontal annular wall, said cap also including an annular lip extending radially outward from the upper end of said vertical annular wall and overlying only the radially inner part of said horizontal annular wall in spaced relation thereto, whereby said discharging liquid flows upwardly along the radially inner surface of said vertical annular wall and thence radially outward along the upper surface of said lip.

2. The basket of claim 1, in which said lip has a radially outer edge and an annular lower surface slanting downward and radially inward from said outer edge.

3. The basket of claim 1, in which said vertical annular wall protrudes above the uppermost surface of said horizontal annular wall a distance d equal to at least about $$\frac{1}{2}a\left[\frac{X}{VT}\right]^2,$$

where a is the gravitational constant, X is the horizontal distance from the vertical annular wall to the outer edge of the horizontal annular wall, and VT is the velocity of the liquid leaving said lip.

* * * * *